US005441695A

United States Patent [19]

Gladden

[11] Patent Number: 5,441,695

[45] Date of Patent: Aug. 15, 1995

[54] PROCESS FOR THE MANUFACTURE BY SINTERING OF A TITANIUM PART AND A DECORATIVE ARTICLE MADE USING A PROCESS OF THIS TYPE

[75] Inventor: Thomas Gladden, Cormondrèche, Switzerland

[73] Assignee: Asulab S.A., Bienne, Switzerland

[21] Appl. No.: 277,306

[22] Filed: Jul. 22, 1994

[30] Foreign Application Priority Data

Jul. 23, 1993 [CH] Switzerland ..... 02246/93
Jul. 30, 1993 [FR] France ..... 93 09530

[51] Int. Cl.[6] ..... B22F 1/00; B22F 3/16
[52] U.S. Cl. ..... 419/37; 419/38; 419/54; 419/58; 419/60
[58] Field of Search ..... 419/38, 37, 54, 58, 419/60

[56] References Cited

U.S. PATENT DOCUMENTS 5,098,469 3/1992 Rezhets ..... 75/249
5,366,679 11/1994 Streicher ..... 264/125
5,366,688 11/1994 Terpstra et al. ..... 419/36
5,380,476 1/1995 Matsushita et al. ..... 264/63
5,397,531 3/1995 Peiris et al. ..... 419/36

FOREIGN PATENT DOCUMENTS 356131 2/1990 European Pat. Off. .

OTHER PUBLICATIONS

Waldron et al, "Sintering", Hayden, 1978, pp. 1–3, 16–22, 27–31, 45–48, 57–64.
Injection Molding ot Titanium Powders, Kei Ameyama et al, Metal Powder Industries Federation, Princeton, N.J., 1989, "Experimental Procedure", p. 122.
Patent Abstracts of Japan, vol. 14, No. 227, May 15, 1990, JP–A–02 054 733, Kawasaki Steel Corp.
Derwent Publications, Ltd., JP–A–3 122 205, Nippon Steel Corp., May 24, 1991.

*Primary Examiner*—Donald P. Walsh
*Assistant Examiner*—Daniel Jenkins
*Attorney, Agent, or Firm*—Sughrue, Mion, Zinn, Macpeak & Seas

[57] ABSTRACT

The invention relates to a process for the manufacture by sintering of a titanium part, characterized in that is consists of:

(a) mixing a titanium hydride powder with a temporary binding agent,
(b) injecting the mixture obtained into a mold to obtain a part in the desired shape,
(c) removing the binding agent,
(d) heating the part in a hydrogen atmosphere up to the desired sintering temperature,
(e) replacing the hydrogen atmosphere by a vacuum or a non-reactive atmosphere once the sintering temperature has been reached, and
(f) cooling the part in a non-reactive gas atmosphere.

13 Claims, No Drawings

PROCESS FOR THE MANUFACTURE BY SINTERING OF A TITANIUM PART AND A DECORATIVE ARTICLE MADE USING A PROCESS OF THIS TYPE

FIELD OF THE INVENTION

The invention relates to a process for the manufacture of a titanium part using powder technologies and notably a process of this type permitting the manufacture of titanium parts by sintering titanium hydride powder ($TiH_2$), the porosity of these parts being less than about 2%. The invention also relates to a decorative article made using a process of this type.

The process of the invention is most particularly suitable for the manufacture of semi-finished titanium products which are intended to create decorative articles such as watch cases, chain links for a bracelet, watch dials or the like which present a surface of brilliant intensity after polishing.

DESCRIPTION OF THE PRIOR ART

In recent years, powder metallurgy technologies, notably metal powder injection, have made it possible to produce titanium parts of complex shape which could only previously be obtained by means of the lengthy and costly machining of a block of titanium.

Taking into account the pyrophoric characteristics of titanium powder and the resultant delicate conditions of its handling and working, the use of $TiH_2$ powder which presents no risk of spontaneous inflammation on simple contact with air has been developed to produce titanium parts by sintering.

A process of this type is described in the publication by Kei Ameyama et al. entitled "INJECTION MOLDING OF TITANIUM POWDERS" published by the Metal Powder Industries Federation, 105 College Rd., east, Princeton, N.J. 08540, USA, 1989, pages 121 to 126.

According to this process, $TiH_2$ powder is first mixed with a binding agent formed of a mixture of polymer, a plasticiser and wax. The mixture thereby obtained is then injected into a mould to obtain a part of the desired shape. The shaped part is then first freed from its binding agent by heating in air and then introduced into an oven having an argon or nitrogen atmosphere or a vacuum, in which it is progressively heated to about 1,100° C. in order to sinter it.

Analysis of the porosity of the parts obtained using this process has shown that the parts with the lowest porosity were obtained by sintering in a vacuum or in an argon atmosphere and that the porosities attained were of the order of 3%. This is due to the violent liberation of hydrogen from the titanium hydride at the moment of heating which creates a large number of bubbles or pores.

Despite this low porosity, micropores appear on the surface of the parts after they have been polished, these micropores producing a diffusion of the incident light which thereby prevents perfect specular reflection of light impinging on the part. The result is a surface of matt or milky appearance that is not sufficient for a consumer product aesthetically.

Polishing the titanium parts obtained using this process consequently does not give surfaces that are sufficiently smooth and brilliant to be used as decorative parts, and are limited to technical uses in which the aesthetic appearance is of no importance.

OBJECTS OF THE INVENTION

It is thus an object of the invention to overcome the disadvantages of the above-mentioned prior art by providing a process for the manufacture by sintering of a titanium part which has a very low porosity and which, when polished, presents an aesthetic appearance that fulfiles the requirements for producing decorative titanium application.

BRIEF SUMMARY OF THE INVENTION

It is therefore an object of the invention to provide a process for the manufacture by sintering of a titanium part, characterised in that it consists of:

(a) mixing a titanium hydride powder with a temporary binding agent, (b) injecting the mixture obtained into a mould to obtain a part in the desired shape, (c) removing the binding agent, (d) heating the part in a hydrogen atmosphere up to the desired sintering temperature, (e) replacing the hydrogen atmosphere by a vacuum or a non-reactive atmosphere once the sintering temperature has been reached, and (f) cooling the part in a non-reactive gas atmosphere.

This process produces sintered titanium parts which have a porosity of less than 2%.

DETAILED DESCRIPTION OF THE INVENTION

According to another of its features, the invention relates to a decorative sintered titanium article starting from a titanium hydride powder and having a polished surface obtained by the above-described procedure.

An article of this type therefore presents, after polishing, a more intense brilliance than sintered titanium parts and parts obtained according to the processes of the prior art and is particularly well adapted to the production of decorative articles such as watch cases, chain links for bracelets or the like.

The invention will now be described in detail.

Titanium hydride powder ($TiH_2$), of a high degree of purity (99.5%) and a mean granulometry of the order of a few microns, typically of 10 microns, is mixed in conventional manner with a temporary binding agent in granular form until a homogenous mixture is obtained.

The binding agent is preferably formed of a thermoplastic polymer or copolymer, but may also be formed of wax. This mixture is produced at a temperature between 120° and 180° C. depending on the nature of the binding agent used. The temperature of the mixture is typically of the order of 170° C. with a thermoplastic copolymer.

The mixture obtained in the form of a paste is then injected in conventional manner into a mould having the shape of the part which is to be produced, for example a watch case, with dimensions which take into account the shrinkage of the part during subsequent stages in the process, this shrinkage being typically of the order of 15%. The injection is preferably at a temperature of about 140° C.

The binding agent contained in the shaped part is then removed. The removal is effected in a manner dependant on the type of binding agent. This removal of the binding agent is often effected thermally. To achieve this, the shaped part is introduced into an oven in which it is progressively brought to a temperature between 200° and 300° C. During this heating process, the binding agent is progressively removed by evaporation and, so as not to impair the shape of the part, this heating is effected over a period of from 6 to 9 hours and preferably 8 hours. It is also important for the binding agent to be removed completely so as to prevent the part being polluted by the carbon and/or oxygen of the binding agent which could lead to deterioration in the mechanical properties of the part to be manufactured and in its resistance to corrosion.

Removal of the binding agent is preferably achieved in a vacuum or in a hydrogen atmosphere so as, on the one hand, to avoid any oxidation of the binding agent during its removal and, on the other hand, to increase the speed of the process of removing the binding agent from the part without impairing the shape of the part.

According to an embodiment of the process and notably in the event of the binding agent being a thermoplastic polymer, this latter may also be removed in chemical manner, by suitable acid vapour decomposition.

After the binding agent has been completely removed from the part and according to a particularly important feature of the invention, the atmosphere in the oven is replaced by a hydrogen atmosphere (if the binding agent has not already been removed in a hydrogen atmosphere) and this hydrogen atmosphere is preferably produced in the form of a flow circulating in the oven in continuous manner. The temperature of the part is simultaneously progressively increased until it reaches the desired sintering temperature. The sintering temperature is between 1,000° and 1,400° C. and, preferably, substantially equal to 1,200° C. to avoid coming too close to a temperature in which the part would begin to lose its shape.

This heating lasts about 5 to 7 hours. During the heating, the titanium hydride progressively liberates its hydrogen. In this connection it is important, according to the process of the invention, that heating is not too rapid in order to avoid rapid liberation of the hydrogen which could cause pore formation within the part and also thereby change the brilliance of the surface after it has been polished. The rate of heating is preferably between 150° C. and 250° C. per hour.

By heating the part in a hydrogen atmosphere, the hydrogen of the titanium hydride is progressively liberated which thus greatly reduces the tendency of bubble or pore formation within the part. Moreover, in view of the high reactivity of the titanium at high temperature, the process of the invention rules out, in advantageous manner, the risk of the titanium reacting with components other than hydrogen which could affect the purity of the part obtained.

Once the sintering temperature has been reached and the hydrogen of the part has been largely liberated, the atmosphere in the oven is replaced again, i.e. the hydrogen is replaced by a non-reactive atmosphere such as argon or helium or by a vacuum. Argon is preferred. The hydrogen is replaced by a non-reactive atmosphere while the part is kept at its sintering temperature. This stage takes between 5 and 80 minutes, preferably about 20 minutes.

The part is then cooled to the ambient temperature in said non-reactive atmosphere at. a cooling rate of the order of 300° C. per hour. During this cooling, the part slowly liberates the rest of its hydrogen which is removed stepwise.

The sintered titanium part obtained by the process that has just been described presents a remarkably low porosity, less than 2%.

This part can therefore be subjected to specular polishing of its surface in order to obtain a decorative article such as a watch case, a chain link for a bracelet, a dial or the like, having a surface of intense polish and brilliance.

The following example is a preferred embodiment of the manufacturing process by sintering of a titanium part forming the object of the invention.

EXAMPLE

A binding agent composed of a copolymer comprising 32% by volume of polyethylene oxide (246 g) and 4% by volume of polypropylene (26 g) is prepared in a container. This binding agent is heated to a temperature of about 170° C. to obtain a homogenous mass. There is then added thereto 64% by volume of $TiH_2$ (1920 g) having a degree of purity of 99.5%, which is mixed with the binding agent until a homogeneous paste is obtained.

This is followed by granulation of the cooled mixture. The granules obtained are then introduced into an injection moulding machine and injected into a mould having, for example, the shape of a watch case, at a temperature of about 140° C.

The shaped part is then introduced into an oven in which a vacuum of about $10^{-2}$ millibar is produced. The part is then brought to a temperature of about 300° C. by linear heating over 8 hours.

The part is then sintered by replacing the vacuum in the oven by a hydrogen atmosphere in the form of a flow having a rate of 150 ml/mn and the part is brought linearly from 300° C. to 1,200° C. over 4 hours. Once the temperature of 1,200° C. has been reached, the hydrogen atmosphere is replaced by a nitrogen atmosphere in the form of a flow having a rate of 150 ml/mn and the temperature of 1,200° C. is maintained for about 20 minutes.

The part is then linearly cooled to ambient temperature in the same nitrogen atmosphere. The rate of cooling is 300° C. per hour and a sintered titanium part is then obtained, the porosity of which is 1.5%.

The sintered part is finally subjected to electropolishing to obtain a watch case having an intense, brilliant appearance.

As a variant of the above example, a polyacetal is used as binding agent and the latter is removed by decomposition in nitric acid vapour at 120° C. The result obtained with this variant is identical to that obtained with the preceding example.

I claim:

1. A process for the manufacture by sintering of a titanium part, comprising the steps of:

(a) mixing a titanium hydride powder with a temporary binding agent, (b) injecting the mixture obtained into a mould; to obtain a part in the desired shape, (c) removing the binding agent, (d) gradually heating the part in a hydrogen atmosphere up to a desired sintering temperature, (e) replacing the hydrogen atmosphere by a non-reactive atmosphere once the sintering temperature has been reached, while keeping the part at said sintering temperature for between 5 and 60 minutes, and (f) gradually cooling the part in a non-reactive gas atmosphere.

2. A process according to claim 1 wherein step (d) consists in heating the part at a temperature between 1,000° and 1,400° C.

3. A process according to claim 2 wherein step (d) is carried out for between 4 and 8 hours.

4. A process according to claim 1 wherein, during step (d), the hydrogen is supplied in the form of a continuous flow.

5. A process according to claim 1 wherein, during the steps (e) and (f), the non-reactive atmosphere is argon or helium.

6. A process according to claim 1 wherein step (c) is carried out chemically or thermally.

7. A process according to claim 6 wherein step (c) is carried out in a vacuum at a temperature below 300° C.

8. A process according to claim 7 wherein step (c) is carried out for between 6 and 9 hours.

9. A process according to claim 6 wherein the binding agent is a thermoplastic polymer and wherein step (c) comprises the chemical decomposition of the polymer by an acid vapour.

10. A process according to claim 1 which comprises a supplementary step (g) during the course of which the part is subjected to specular polishing.

11. The process according to claim 1, wherein the cooling step is maintained until the part has a porosity of 2%.

12. The process according to claim 1, wherein the non-reactive atmosphere is a vacuum.

13. A process according to claim 1, wherein the part is maintained at said sintering temperature for about 20 minutes.

* * * * *